US011421968B2

(12) United States Patent
Trpkovski

(10) Patent No.: US 11,421,968 B2
(45) Date of Patent: Aug. 23, 2022

(54) ARROW END

(71) Applicant: Ravin Crossbows, LLC, Superior, WI (US)

(72) Inventor: Paul Trpkovski, Kailua Kona, HI (US)

(73) Assignee: RAVIN CROSSBOWS, LLC, Superior, WI (US)

( * ) Notice: Subject to any disclaimer, the term of this patent is extended or adjusted under 35 U.S.C. 154(b) by 45 days.

(21) Appl. No.: 17/144,022

(22) Filed: Jan. 7, 2021

(65) Prior Publication Data

US 2021/0223010 A1 Jul. 22, 2021

Related U.S. Application Data

(60) Provisional application No. 62/957,797, filed on Jan. 7, 2020.

(51) Int. Cl.
*F42B 6/08* (2006.01)
*A63H 27/00* (2006.01)

(52) U.S. Cl.
CPC ..... *F42B 6/08* (2013.01); *A63H 27/005* (2013.01); *A63H 27/007* (2013.01); *A63H 27/12* (2013.01)

(58) Field of Classification Search
CPC .... A63H 27/005; A63H 27/007; A63H 27/12; F42B 6/08
See application file for complete search history.

(56) References Cited

U.S. PATENT DOCUMENTS 3,014,305 A * 12/1961 Yurchich ..... F42B 6/08 43/6
3,390,480 A * 7/1968 Turner ..... A63H 27/12 446/45
5,284,454 A * 2/1994 Randolph ..... A63H 27/12 446/64
5,413,514 A * 5/1995 Milligan ..... A63H 27/007 446/211
5,690,533 A 11/1997 Harris et al.
6,048,246 A * 4/2000 Forti ..... A63H 27/007 446/64
6,102,765 A * 8/2000 Forti ..... A63H 27/007 446/64
6,247,990 B1 * 6/2001 Moorhouse ..... A63H 27/007 446/64
8,096,848 B2 * 1/2012 Hollis ..... A63H 27/007 446/62

(Continued)

OTHER PUBLICATIONS

GearBest; www.YouTube.com (http://youtube.com/watch?v=252-9IPH6do)—"HY 558A Arrow Helicopter Faery Flying Toy with LED from GearBest.com"; Jun. 4, 2015; 1 page.

*Primary Examiner* — John A Ricci
(74) *Attorney, Agent, or Firm* — Foley & Lardner LLP

(57) ABSTRACT

An archery arrow end includes a main body that has a first end and a second end. The main body defines a longitudinal axis. The archery arrow end includes a tip positioned at the first end. The tip has a blunt end. The archery arrow end includes an arrow shaft connector positioned at the second end. The arrow shaft connector is configured to be attached to an arrow shaft. The archery arrow end includes flexible wings that extend from the main body in a direction at least partially toward the second end. Each wing has a free end configured to move toward and away from the longitudinal axis.

22 Claims, 7 Drawing Sheets

(56) References Cited

U.S. PATENT DOCUMENTS

| | | | | |
|---|---|---|---|---|
| 8,282,437 | B2 * | 10/2012 | Norman | A63H 3/003 446/40 |
| 8,678,960 | B2 * | 3/2014 | Bierfreund | F42B 6/08 473/583 |
| 9,341,451 | B1 * | 5/2016 | Campbell | F42B 12/34 |
| 9,843,704 | B2 * | 12/2017 | Lyren | H04N 5/44 |
| 9,903,681 | B2 * | 2/2018 | Walterscheid | A63H 27/14 |
| 10,281,251 | B2 * | 5/2019 | Jackson | F41J 3/0057 |
| 10,371,491 | B2 * | 8/2019 | Bynum, Jr. | F41J 3/0004 |
| 2014/0349541 | A1 * | 11/2014 | Shyutten | A63H 33/18 446/36 |

* cited by examiner

ARROW END

CROSS-REFERENCE TO RELATED APPLICATION(S)

This application claims the benefit of U.S. Provisional Patent Application Ser. No. 62/957,797, filed Jan. 7, 2020, the disclosure of which is hereby incorporated by reference in its entirety.

BACKGROUND

Flares and other auxiliary instruments are traditionally used in remote situations where an individual needs to signal other for attention, such as in an emergency. However, such signaling means often require the individual to carry bulky items, such as a flare gun. Such items can be burdensome when hiking into a remote area. Because of this annoyance, individuals are less likely to bring auxiliary instruments, and, therefore, put themselves at risk of being unable to signal aid in the event of an emergency.

Projectiles, specifically arrows and archery tips, come in a variety of styles and shapes depending on their applications. For example, arrow tips designed for hunting, target shooting, bowfishing, and warfare are known. Traditionally, arrow tips are designed to attach to an arrow shaft via a threaded connection. Typically, an 8-32 thread is used.

There exists a need for improvements in arrow tip design. Specifically, there exists a need for an arrow tip can that can function as an auxiliary instrument.

SUMMARY

This application generally relates to projectiles for projectile launchers. Specifically, this application generally relates to archery arrows, and more particularly to an archery tip with two or more flexible wings to enable the arrow and the tip to float back to the ground after being shot into the air.

In one aspect of the present disclosure an archery arrow end is disclosed. The archery arrow end includes a main body that has a first end and a second end. The main body defines a longitudinal axis. The archery arrow end includes a tip positioned at the first end. The tip has a blunt end. The archery arrow end includes an arrow shaft connector positioned at the second end. The arrow shaft connector is configured to be attached to an arrow shaft. The archery arrow end includes flexible wings that extend from the main body in a direction at least partially toward the second end. Each wing has a free end configured to move toward and away from the longitudinal axis.

In another aspect of the present disclosure an arrow disclosed. The arrow includes a shaft that has a shaft first end and a shaft second end. The arrow includes a fletching attached to the shaft at the shaft second end and an arrow end connected to the shaft first end. The arrow end includes a main body that has a first end and a second end. The main body defines a longitudinal axis. The arrow end includes a tip positioned at the first end and the tip has a blunt end. The arrow end includes an arrow shaft connector that is positioned at the second end. The arrow shaft connector is connected to the shaft first end of the arrow shaft. The arrow end includes a flexible wings that extend from the main body in a direction at least partially toward the second end of the main body. Each wing has a free end and is configured to move toward and away from the longitudinal axis.

In another aspect of the present disclosure a method of suspending a fall of an arrow is disclosed. The method includes propelling an arrow into the air along a flight path. The flight path is parabolic and has an apex. The arrow includes a shaft that has a shaft first end and a shaft second end. The arrow includes a plurality of vanes attached to the shaft at the shaft second end and an arrow tip connected to the shaft first end, the arrow end includes a main body that has a first end and a second end. The main body defines a longitudinal axis. The arrow end includes a tip positioned at the first end of the main body and the tip has a blunt end. The arrow end includes an arrow shaft connector positioned at the second end of the main body. The arrow shaft connector is connected to the shaft first end of the arrow shaft. The arrow end includes flexible wings that extend laterally from the main body in a direction at least partially toward the second end of the main body. Each wing has a free end configured to move toward and away from the longitudinal axis. The method includes deflecting the flexible wings away from the longitudinal axis of the main body of the arrow tip after the arrow reaches the apex of its flight path. The method includes reducing a fall velocity of the arrow by deflecting air across the flexible wings.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Various embodiments will be described in detail with reference to the drawings, wherein like reference to numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The present disclosure describes an arrow end that is adapted to be connected to an arrow, specifically for use in archery, which is fireable via a bow (e.g., a compound bow, a recurve bow, a crossbow, etc.). The arrow end disclosed herein is configured to arrest the fall to earth of an attached arrow. By reducing the velocity of the falling arrow, the arrow end can utilize (e.g., signal, deploy, etc.) an auxiliary instrument attached thereto. In some examples, the arrow end can include flexible wings that deploy outward when the arrow begins falling back to earth so as to slow the fall of the arrow. For example, the arrow end can include a LED and/or a communication beacon that enables the shooter of the arrow to signal to those nearby, similar to a flare. By providing an arrow end that can be connected to a standard arrow shaft, the individual can be prepared while not needing to carry specialized signaling equipment (e.g., a flare gun). Further, in some examples, the arrow end includes a communication beacon that allows the individual to shoot the arrow in the air to broadcast an S.O.S signal at a higher elevation, thereby avoiding low elevation interference.

Figure 1:
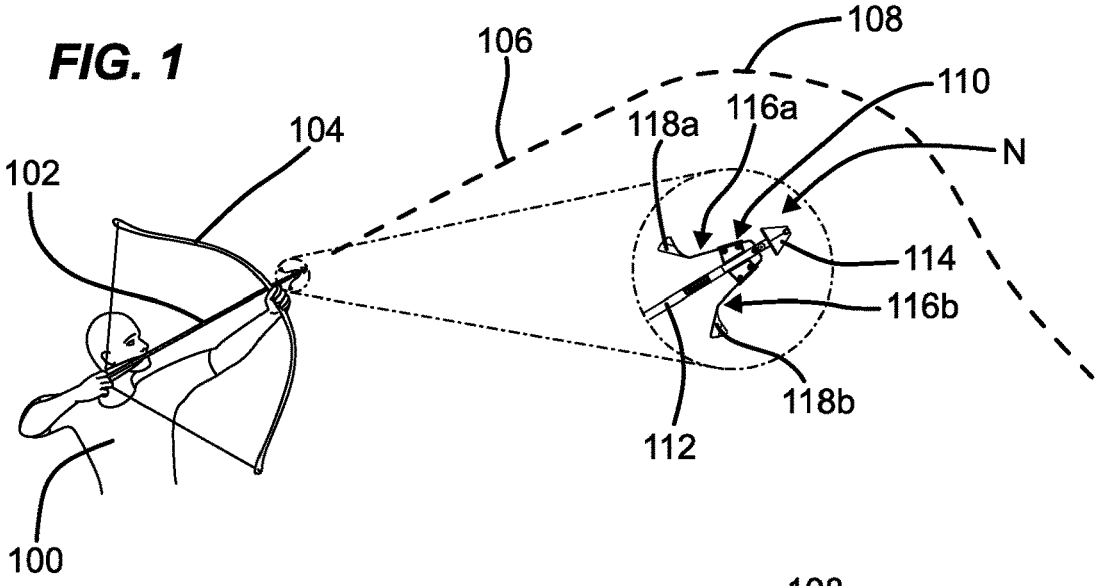
FIG. 1 is a schematic depiction of a user preparing to fire an arrow having an end wings in a neutral position along a flight path.

FIG. 1 shows a user 100 preparing to propel an arrow 102 from a bow 104 into the air. The arrow 102 has a parabolic flight path 106 where the flight path 106 has an apex 108. In some examples, the apex 108 is the peak of the flight path 106. The arrow 102 includes an end 110 positioned at the front of a shaft 112 of the arrow 102. The end 110 includes a tip 114 and rearward facing, flexible wings 116, such as including a pair of flexible wings 116*a*, 116*b*. As shown in FIG. 1, when the end 110 is at rest (i.e., not passing through the air), the wings 116*a*, 116*b* are in a neutral position N.

Figure 2:
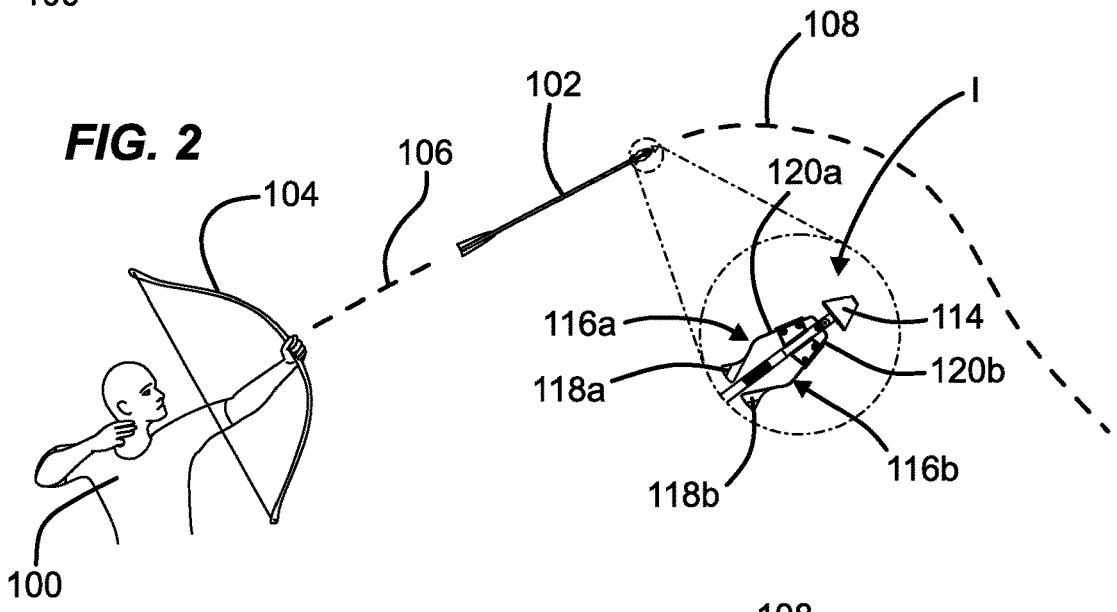
FIG. 2 is a schematic depiction of a user firing the arrow of FIG. 1 along the flight path where the wings positioned inward.

FIG. 2 shows the user 100 propelling the arrow 102 into the air along the flight path 106. As shown, the arrow 102 is gaining elevation, end 110 first, toward the apex 108 of the flight path 106. Because the arrow 102 is moving through the air, end 110 first, and the wings 116*a*, 116*b* are flexible and rearward facing, the wings 116*a*, 116*b*, specifically free ends 118*a*, 118*b*, are deflected to an inward position I, toward the shaft 112 of the arrow 102. As the arrow passes forward through the air, air exerts a force on a front side 120*a*, 120*b* of the wings 116*a*, 116*b*, pushing the wings 116*a*, 116*b* toward the shaft 112. The inward position I of the wings 116*a*, 116*b* allows the arrow to fly through the air with minimal interference from the wings 116*a*, 116*b*.

Figure 3:
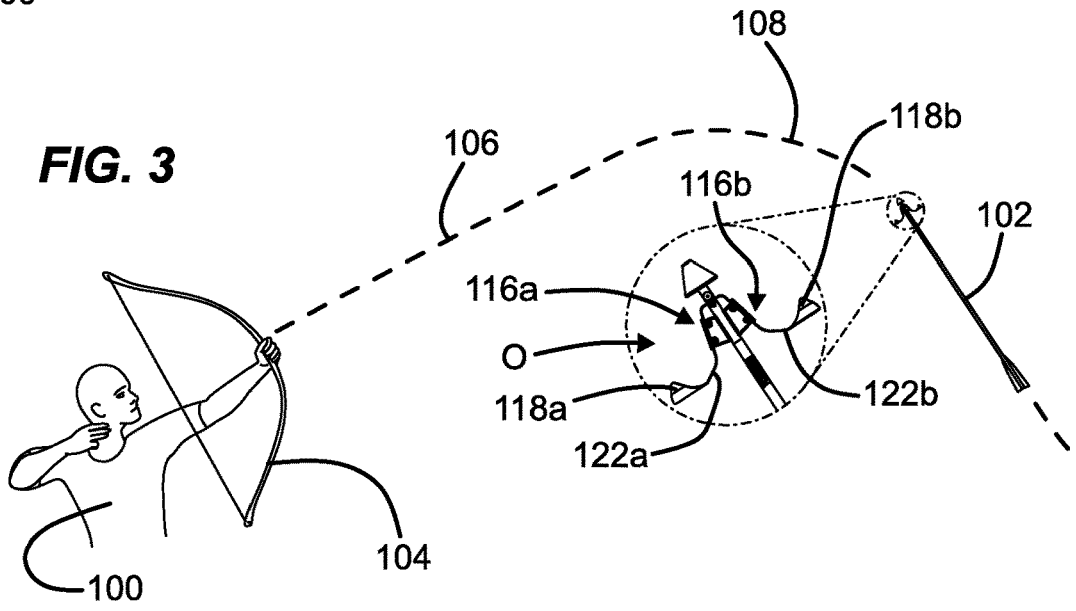
FIG. 3 is a schematic depiction of a user firing the arrow of FIG. 1 along the flight path where the wings positioned outward.

FIG. 3 shows the arrow 102 falling back to earth, past the apex 108 of the flight path 106. As the arrow passes the apex 108, the wings 116*a*, 116*b* move to an outward position O, where the free ends 118*a*, 118*b* extend away from the shaft 112 of the arrow 102. Because the wings are flexible, when the arrow 102 reaches the apex 108, the arrow's forward velocity slows and air is able to instead push the wings 116*a*, 116*b* outward, exerting a force at a back side 122*a*, 122*b* of the wings 116*a*, 116*b*. By moving the outward position O, the wings 116*a*, 116*b* create drag and therefore reduce the fall velocity of the arrow 102 as the arrow falls back to earth due to gravity.

Figure 4:
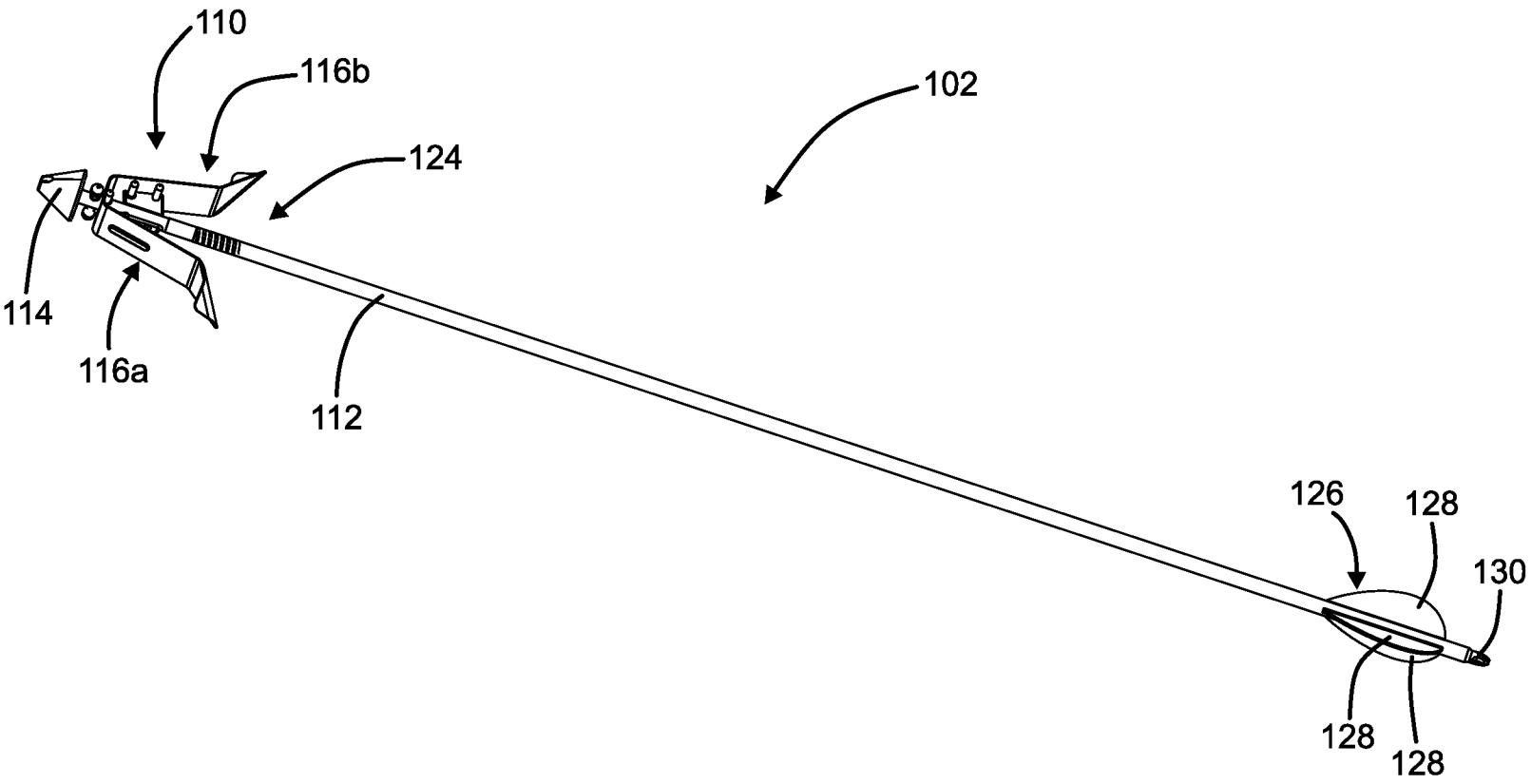
FIG. 4 is a perspective view of the arrow of FIG. 1 with the wings in the neutral position.

FIG. 4 shows a perspective view of the arrow 102. The arrow 102 includes the shaft 112 that has a shaft first end 124 and a shaft second end 126. The arrow 102 includes the arrow end 110 attached to the shaft first end 124, a fletching 128 attached to the shaft 112 at the shaft second end 126, and a nock 130 positioned adjacent to and behind the fletching 128. In some examples, the arrow 102 can use vanes instead of fletching. The fletching 128 can be constructed of a plurality of different materials such as, but not limited to, feathers and plastic. The nock 130 is configured to interface with a drawstring of the bow 104 so that the bow 104 propels the arrow 102.

Figure 5:
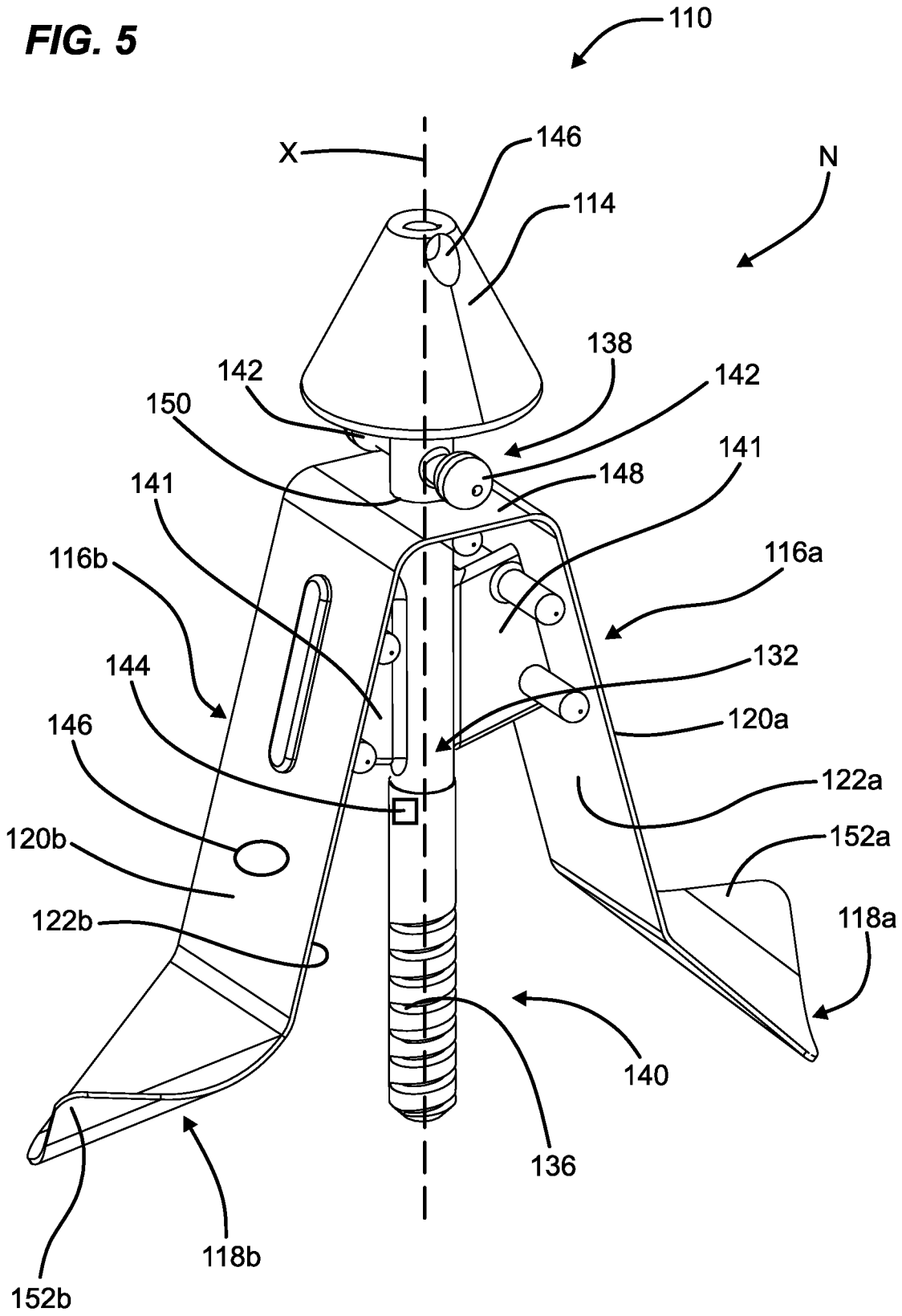
FIG. 5 is a perspective view of the end of arrow of FIG. 1 with the wings in the neutral position.
Figure 6:
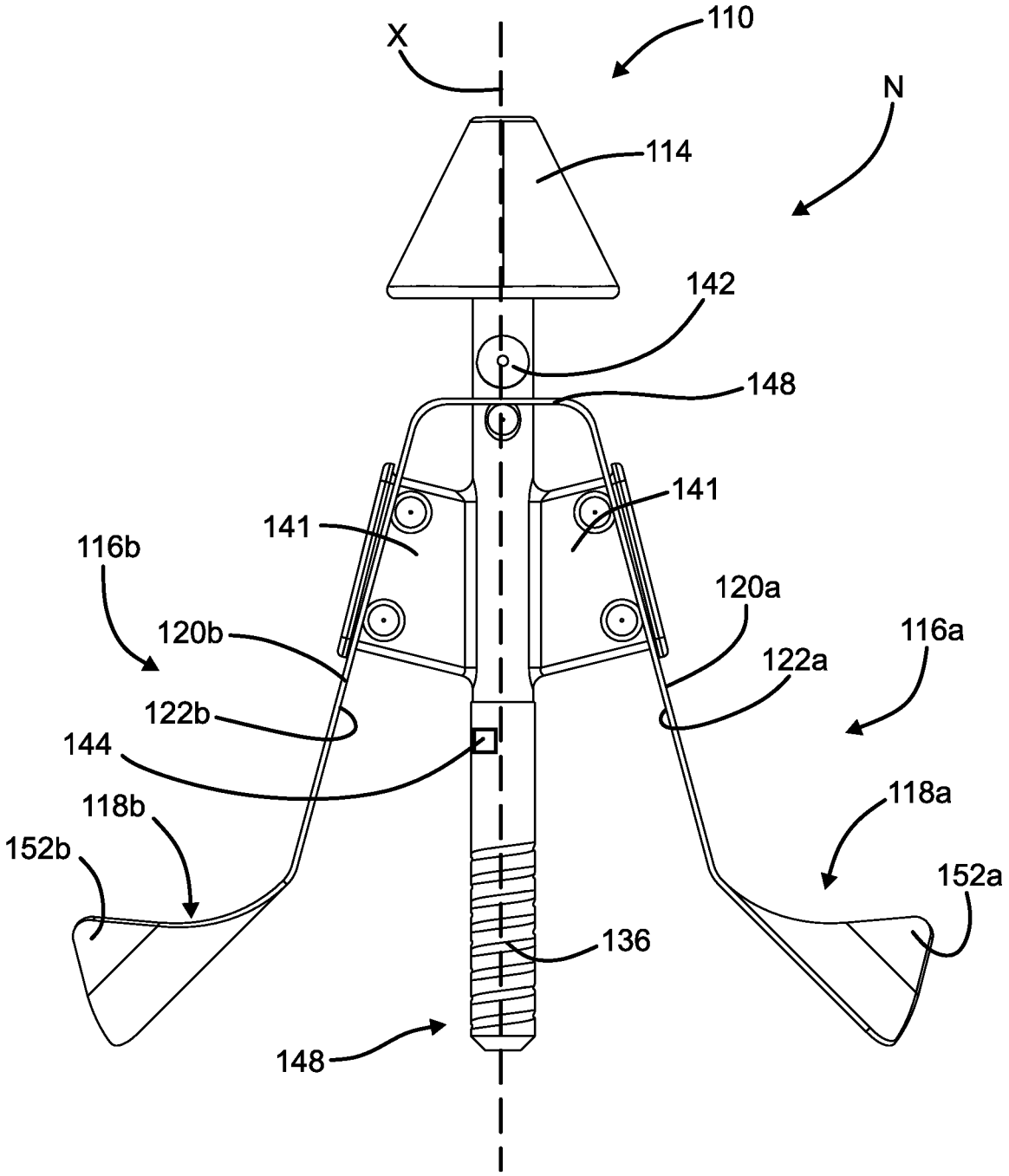
FIG. 6 is a side view of the end of the arrow of FIG. 1 with the wings in the neutral position.
Figure 7:
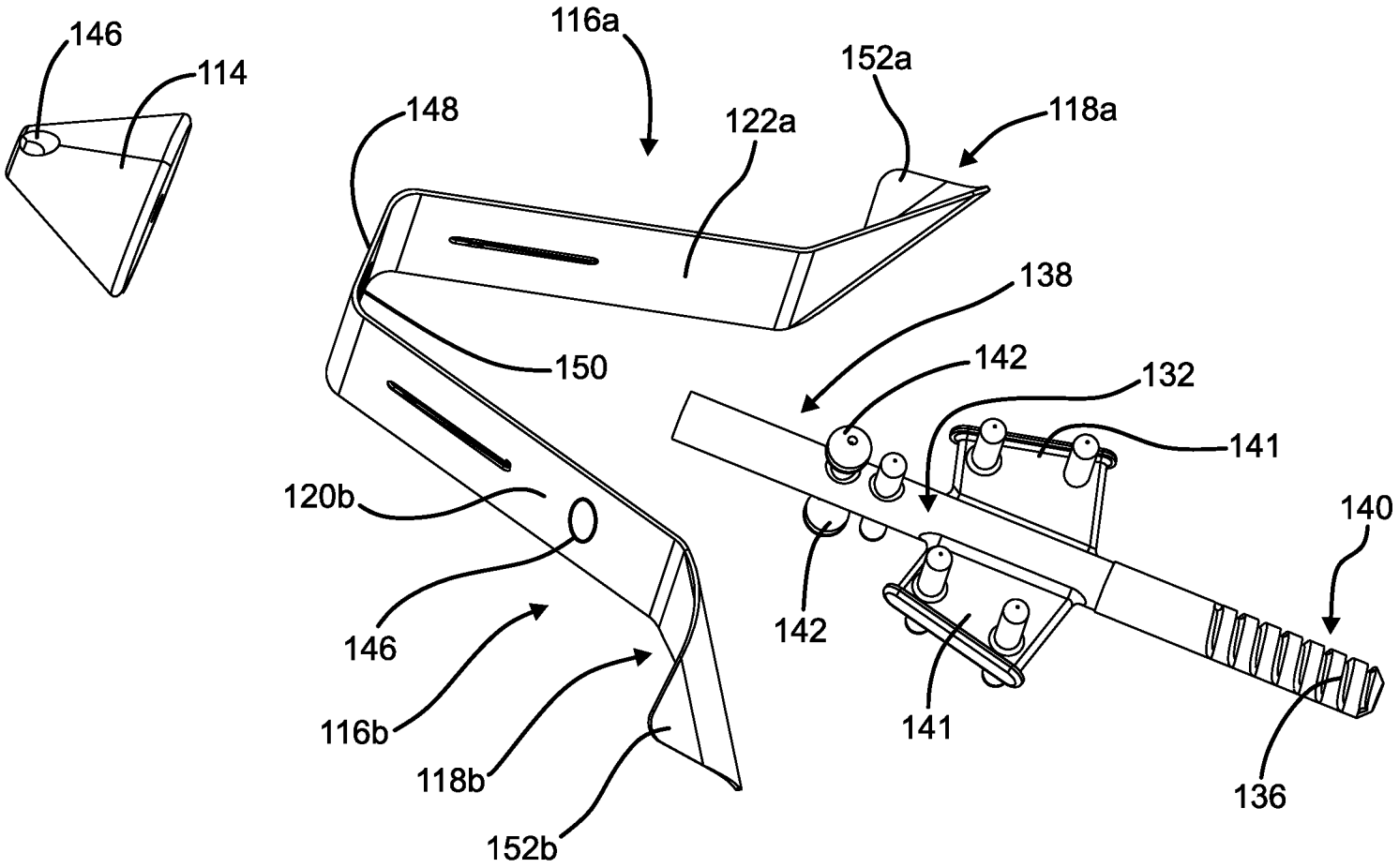
FIG. 7 is an exploded view of the end of the arrow of FIG. 1 with the wings in the neutral position.

FIG. 5 shows a perspective view of the end 110 of the arrow 102, and FIG. 6 shows a side view of the end 110 of the arrow 102. In some examples, the end 110 is quickly detachable from the shaft 112 so that a different end (often referred to as "arrowhead" or "tips") may be secured to the same shaft 112. In other examples, the end 110 is permanently attached to the shaft 112. In some examples, the end 110 is configured to be transported detached from the shaft 112 and can be attached to the shaft 112 when needed, such as when in the field. The end 110 includes a main body 132, the tip 114, an arrow shaft connector 136, and the pair of flexible wings 116*a*, 116*b*.

The end 110 can have an overall weight in a range from 25 to 1000 grains. In some examples, the end 110 can have an overall weight in a range from 25 to 250 grains. In some examples, the end 110 can have an overall weight in a range from 50 to 200 grains. In some examples, the end 110 can have an overall weight in a range from 100 to 150 grains. In some examples, the end 110 can have an overall weight of about 125 grains.

In some examples, the end 110 can be utilized alone, without being attached to the shaft 112 of the arrow 102. For example, the end 110 can be fired from a slingshot, or other mechanism, without a shaft 112.

The main body 132 has a first end 138, a second end 140, and a longitudinal axis X. In some examples, the longitudinal axis X is axially aligned with a longitudinal axis of the shaft 112. The main body 132 can be formed from a variety of materials such as, but not limited to, plastic, metal, carbon fiber, or the like. In some examples, the main body includes a pair of extensions 141 that are configured to attach the wings 116*a*, 116*b*. Further, in some examples, the main body 132 can provide a rigid, yet lightweight platform to fix an auxiliary instrument 142 thereto. In some examples, the main body 132 is hollow and provides space for the auxiliary instrument 142 to be mounted therein.

The auxiliary instrument 142 can be utilized to signal when the end 110 is attached to the shaft 112 and shot into the air. In some examples, the auxiliary instrument 142 can be utilized to actively signal while the arrow 102 is in its flight path. In other examples, the auxiliary instrument 142 can be configured to only signal when the arrow 102 is at and/or past the apex 108 of its flight path. For example, the auxiliary instrument 142 can include one or more sensors, such as an accelerometer (e.g., 3-axis accelerometer), a gyroscope, a switch (e.g., an acceleration or inertia switch). In some embodiments the auxiliary instrument includes a microprocessor or other integrated circuit that controls the signal or other electrical components described herein. In some examples, the end 110 includes more than one auxiliary instrument 142.

In some examples, the auxiliary instrument 142 is or includes at least one light source, such as a light emitting diode (LED). In some examples, the LED can be attached to, or embedded within, the main body 132, the tip 114, and/or the pair of flexible wings 116*a*, 116*b*. The LED can be powered via a power source 144, such as a battery, turbine, solar cell, etc. The LED can be partially positioned within, or attached to, an exterior of the main body 132. In some examples, the power source 144 is embedded within the main body 132 so as to not to interfere with aerodynamics of the end 110 while also ensuring proper weight distribution. In some examples, the LED can be configured to emit light having particular patterns and/or colors. For example, the LED can emit a pulsing red light.

In some examples the auxiliary instrument 142 includes a power source 144, such as a battery. The power source can be located at various places including: attached to the main body 132, embedded within or arranged within the main body 132, attached to or arranged within the tip 114, or attached to or arranged within the arrow shaft 112. The power source 144 is configured to supply power to one or more electronic components, such as the light source, or any of the other electronic components described herein. The power source can be connected to the electronic components using one or more wires or other electrically conductive components.

In some examples, the auxiliary instrument 142 is a communications beacon. The communications beacon can be configured to broadcast a signal, such as an S.O.S. signal. In some examples, the communications beacon can utilize a microprocessor and a radio transmitter to broadcast an identification signal. The identification signal can include information such as one or more of: a personal identifier, a device identifier, and a location. In some examples, the communications beacon can include a radio transmitter that is configured to communicate over the IEEE L-band at a frequency range from 1 to 2 GHz. Other wireless communication technologies can be used in other embodiments, such as including Wi-Fi®, Bluetooth® (e.g., long range Bluetooth), LoRa, Zigbee®, cellular, satellite, and the like.

In some embodiments the auxiliary instrument 142 includes a radio receiver, which can be used to receive radio frequency communication signals. In some embodiments the radio receiver can be part of the communications beacon radio transmitter in the form of a radio transceiver. The receiver can operate to receive radio frequency signals including communication signals and location signals. For example, the radio receiver can be or can include a Global Positioning System (GPS) receiver, or other satellite receiver. Any of the communication technologies listed above can similarly be used by various embodiments of the radio receiver.

In some examples, the communications beacon, radio transmitter, or radio receiver can utilize one or more of, but is not limited to: GPS, GNSS (Global Navigation Satellite System), Galileo, GLONASS, BeiDo, Quasi-Zenith Satellite System (QZSS) or other communication technologies. In other examples still, the communications beacon can utilize the Globalstar, Iridium, etc. communications networks. Similar to the light source/LED discussed above, the communications beacon (or radio transmitter, receiver, or transceiver) can be attached to, or embedded within similar structures, including the main body 132, the tip 114, and/or the pair of flexible wings 116*a*, 116*b*. The communications beacon can be powered via the power source 144.

In some examples, the auxiliary instrument 142 is a communications enhancer. The communications enhancer can utilize wireless technology to wirelessly communicate with another electronic device (e.g., a mobile device such as a cell phone) to allow for extended connection range. In one example, the communications enhancer is a wireless signal booster (e.g., cellular signal booster), which includes one or more communication devices, and one or more antennas. The wireless signal booster communicates with the user's wireless device, such as a cell phone, and also communicates with a distant communication device such as a cellular network. For example, a user can propel the arrow 102 with the end 110 having a communications enhancer attached thereto, to a higher elevation. Once at a higher elevation, the communications enhancer provides a better signal for the wirelessly connected mobile device. This could be advantageous in a wilderness emergency situation. Similar to the light source, the communications enhancer can be attached to, or arranged within, the main body 132, the tip 114, and/or the pair of flexible wings 116*a*, 116*b*. In some embodiments the arrow shaft 112 or the main body 132 can function as the antenna, such that a separate antenna is not needed. In some examples, the communications enhancer can be powered via the power source 144.

In some examples, the auxiliary instrument 142 is or includes a camera. In some examples, the camera can be configured to capture and record digital images or video during the flight of the arrow 102. In some examples, the camera can wirelessly transmit one or more images or video from the arrow 102 to a mobile device. For example, an individual may seek to perform surveillance over a certain area and propel the arrow 102 with the end 110 near the area. The video may then be used to ascertain the status of the area, and/or aid in signaling others of that particular area (e.g., in a warzone). In other examples, the camera may record footage to on-board memory (e.g., a memory card, such as an SD card and the like). In some embodiments the auxiliary instrument 142 includes a memory card slot, and the on-board member is removable, such as by removing the memory card from the memory card slot. The auxiliary instrument 142 can also include a communication connector for receiving a communication cable, to connect the auxiliary instrument 142 to another computing device. An example of a communication connector is a Universal Serial Bus (USB) connector, which can be one of various types and sizes. Images or videos (or other data) can be transferred to or from the on-board memory to the other computing device using a cable and the communication connector. Similar to the other examples described above, the camera, on-board memory, and/or communication connector can be attached to, or arranged within, the main body 132, the tip 114, and/or the pair of flexible wings 116*a*, 116*b*. In some examples, the camera can be powered via the power source 144.

In some examples, the auxiliary instrument 142 is a noise maker, such as, but not limited to a whistle, beeper, or the like. In some examples, the noise maker is or includes at least one aperture 146 within at least one of the wings 116*a*, 116*b* and/or the tip 114. As air travels across and through the aperture, a noise is created. In some examples, the noise is only created when air exerts a force on the back side 122*a*, 122*b* of the wings 116*a*, 116*b*. In some examples, the noise maker can emit an emergency sound. In other examples, the noise make can emit an animal call (e.g., for use in hunting). Similar to the other examples described above, the noise maker can be attached to, or embedded within, the main body 132, the tip 114, and/or the pair of flexible wings 116*a*, 116*b*. In some examples, the noise maker can be powered via the power source 144.

The tip 114 is configured to be adjustable to control the flight of the arrow 102 and help to protect the end 110. Specifically, the tip is positioned at the first end 138 of the main body and is configured to be the leading end of the arrow 102 when the arrow is fired with an end 110 attached thereto. In some examples, the tip 114 is conical; however, it is considered with the scope of the present disclosure that the tip 114 can have a variety of different shapes. In some examples, the tip 114 is blunt. In some examples, the tip 114 is made from a material that is at least partially shock absorbing such as, but not limited to, rubber, foam, carbon fiber, etc. In some examples, depending on if the auxiliary instrument 142 is equipped, the tip 114 can be adjusted in either shape, material, or weight to adjust the aerodynamics of the end 110.

The arrow shaft connector 136 is configured to connect the end 110 with the shaft 112 of the arrow 102. Specifically, the arrow shaft connector 136 is positioned at the second end 140 of the main body, opposite from the tip 114. In some examples, the arrow shaft connector 136 is configured to have a threaded connection and configured to be received in the shaft 112. In some examples, the thread is a 8-32 thread. In some examples, the arrow shaft connector 136 can be a smooth shaft that is configured to be received by, and secured to, the shaft 112. In some examples, the arrow shaft connector 136 includes a sleeve that has a recess that is configured to receive, and secure to, the shaft 112.

The pair of flexible wings 116*a*, 116*b* are configured to be connected to the main body 132, and aid in reducing the falling velocity of the attached arrow 102. In some examples, the wings 116*a*, 116*b* extend laterally from the main body 132 in a direction at least partially toward the second end 140 of the main body 132. In some examples, the end 110 includes a single wing. In some examples, the end 110 includes more than two wings. Wings are merely shown as an example of a mechanism that can reduce the falling velocity of the arrow; however, it is contemplated that other like mechanisms can be utilized such as, but not limited to, a parachute.

As mentioned above, the wings 116*a*, 116*b* each include a free end 118*a*, 118*b*. In some examples, the wings 116*a*, 116*b* are connected to one another at a bridge 148, in between the free ends 118*a*, 118. In some examples, the bridge 148 includes an aperture 150 that is configured to receive a portion of the main body 132 therein. In some examples, the wings 116*a*, 116*b* are each attached to the extension 141 of the main body. In some examples, the free ends 118*a*, 118*b* each include an ear 152*a*, 152*b* that are each upturned in the opposite directions, when viewing the end 110 down the longitudinal axis toward the second end 140 of the main body 132, that cause the arrow to rotate in clockwise direction when they encounter a force from air at their back sides 122*a*, 122*b*. This can help to create a centrifugal force on the arrow 102, urging the wings 116*a*, 116*b* to the outward position O, as shown in FIG. 3. In some examples, the wings 116*a*, 116*b* have a helical shape. In some embodiments the wings 116*a*, 116*b* are folded with one or more creases. It is considered within the scope of the present disclosure that the wings can have a variety of different configurations so long as they aid in reducing the falling velocity of the arrow 102 to which the end 110 is attached.

In some examples, the wings 116*a*, 116*b* are constructed of a flexible, resilient material. In some examples, the wings 116*a*, 116*b* are constructed of a material that has a memory and returns the wings to the neutral position N, shown in FIG. 5, when the end 110 is not being propelled through the air. In some example, the wings 116*a*, 116*b* are configured to be forced to, and stored in, the inward position I, shown in FIG. 2, and automatically position themselves back to the neutral position N when the force is removed. In some examples, the wings 116*a*, 116*b* are constructed of a spring steel. In some examples, the wings 116*a*, 116*b* are constructed of a plastic.

Figure 8:
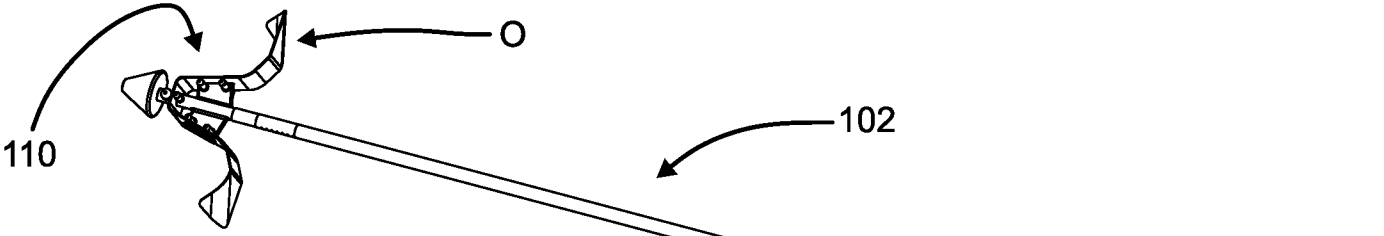
FIG. 8 is a perspective view of the arrow of FIG. 1 with the wings in the outward position.
Figure 9:
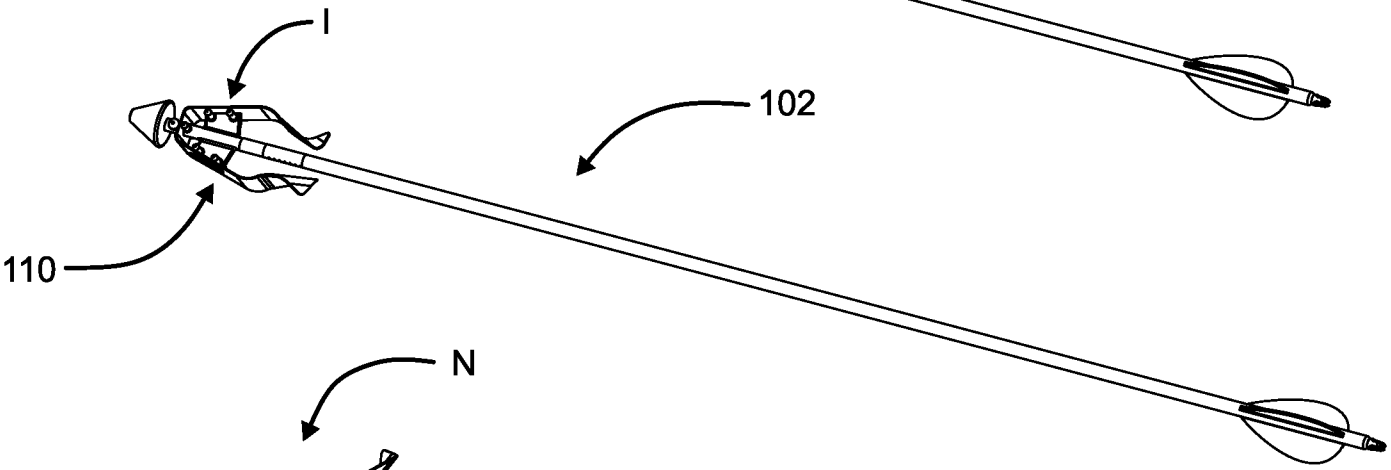
FIG. 9 is a perspective view of the arrow of FIG. 1 with the wings in the inward position.
Figure 10:
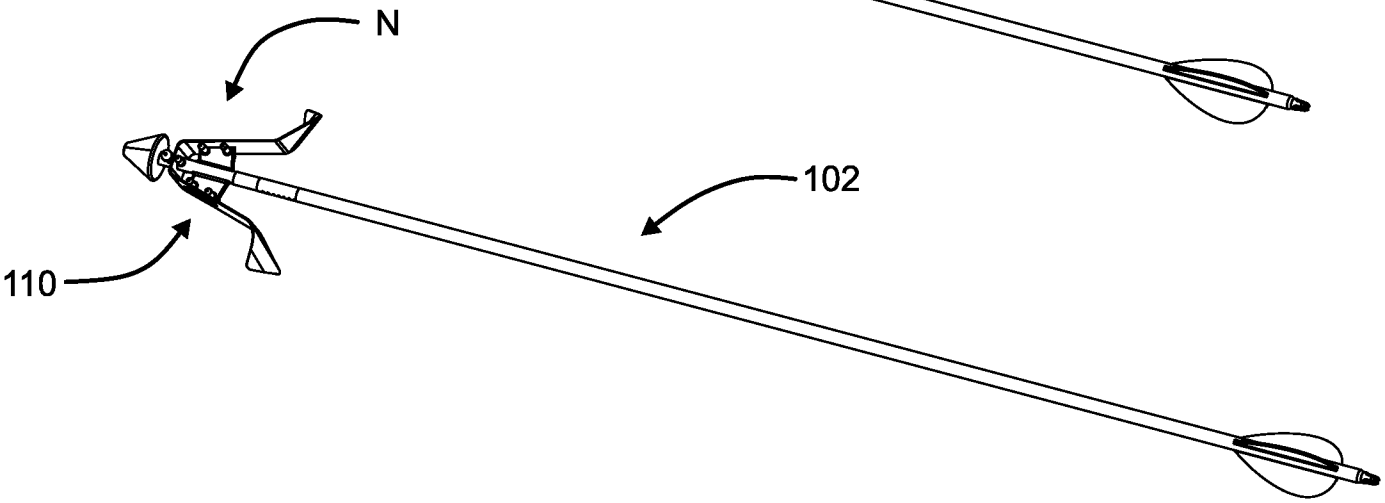
FIG. 10 is a perspective view of the arrow of FIG. 1 with the wings in the neutral position.

FIGS. 8-10 show the arrow 102, specifically the end 110, in the outward O, inward I, and neutral N positions, respectively. As outlined above, a method of suspending a fall of a projectile (e.g. the arrow 102) is disclosed herein. A user propels the arrow 102 into the air along the flight path 106. In some examples, the user causes the end 110, and specifically the wings 116*a*, 116*b* to deflect to from the neutral N position, shown in FIG. 10, to the in the inward I position, shown in FIG. 9, after the user propels the arrow 102 into the air. At and/or after the arrow 102 reaches the apex 108 of the flight path 106, the wings 116*a*, 116*b* are deflected away from the longitudinal axis X of the main body 132, and moved into the outward position O, shown in FIG. 8. Such outward positioning causes the wings 116*a*, 116*b* to create drag on the arrow 102, thereby reducing the fall velocity of the arrow 102 by deflecting air across the wings 116*a*, 116*b*. In some examples, due to the helical shape of the wings 116*a*, 116*b*, the arrow 102 spins as it falls back to earth. In some examples, the arrow 102 emits a noise via the auxiliary instrument 142 when it begins to fall back to earth.

Figure 11:
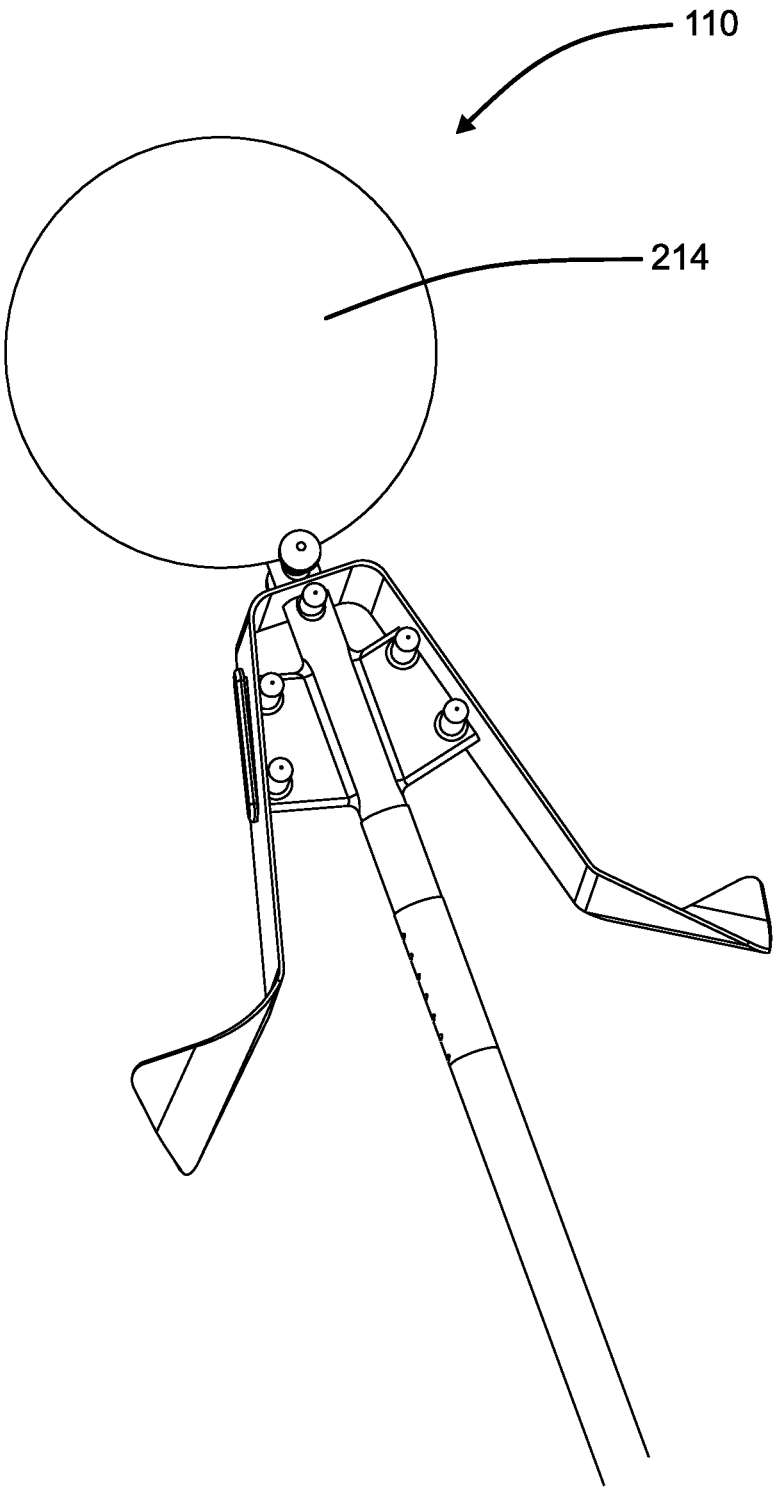
FIG. 11 is a perspective view of the end of the arrow of FIG. 1 with an alternative tip.

FIG. 11 shows the end 110 having an alternative tip 214. In some examples, the tip 214 is spherical. In some examples, the tip 214 is a foam ball. In some examples, the tip 214 is partially inflated. In some examples, the tip 214 can be inflated with a gas. Examples of the gas are air and helium.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. An archery arrow end comprising:

a main body having a first end and a second end, wherein the main body defines a longitudinal axis;

a tip positioned at the first end, the tip having a blunt end;

an arrow shaft connector positioned at the second end, the arrow shaft connector being configured to be attached to an arrow shaft; and flexible wings extending from the main body in a direction at least partially toward the second end, each wing having a free end configured to move toward and away from the longitudinal axis.

2. The archery arrow end of claim 1, wherein the tip is one of a foam or a rubber material.

3. The archery arrow end of claim 1, wherein the tip is one of a conical or a spherical shape.

4. The archery arrow end of claim 1, further comprising a communications antenna.

5. The archery arrow end of claim 1, further comprising a communications beacon attached to the main body, wherein the communications beacon is powered by a power source attached to the main body.

6. The archery arrow end of claim 1, further comprising a whistle attached to the main body.

7. The archery arrow end of claim 6, wherein the whistle is at least one aperture in the flexible wings.

8. The archery arrow end of claim 1, further comprising a camera connected to the main body.

9. The archery arrow end of claim 8, wherein the camera is positioned at least partially within the tip.

10. The archery arrow end of claim 1, further comprising an LED attached to the main body and powered by a power source attached to the main body.

11. The archery arrow end of claim 10, wherein the LED is attached to at least one of the flexible wings.

12. The archery arrow end of claim 1, wherein the flexible wings have at least a partially helical shape.

13. The archery arrow end of claim 1, wherein the arrow shaft connector includes a male threaded interface having an 8-32 thread.

14. The archery arrow end of claim 1, wherein the arrow shaft connector includes a recess, wherein the recess is configured to receive the arrow shaft.

15. The archery arrow end of claim 1, wherein the archery arrow end has a weight in a range from 50 grains to 250 grains.

16. The archery arrow end of claim 15, wherein the archery arrow end weighs about 125 grains.

17. The archery arrow end of claim 1, wherein the arrow shaft connector is connected to a first end of an arrow shaft.

18. An arrow comprising:

a shaft having a shaft first end and a shaft second end;

a fletching attached to the shaft at the shaft second end;

an arrow end connected to the shaft first end, the arrow end including;

a main body having a first end and a second end, wherein the main body defines a longitudinal axis;

a tip positioned at the first end, the tip having a blunt end;

an arrow shaft connector positioned at the second end, the arrow shaft connector being connected to the shaft first end of the arrow shaft; and flexible wings extending from the main body in a direction at least partially toward the second end of the main body, each wing having a free end configured to move toward and away from the longitudinal axis.

19. The arrow of claim 18, wherein the arrow end includes at least one of a camera, a communications beacon, a communications antenna, a LED, or a whistle.

20. A method of suspending a fall of an arrow, the method comprising:

propelling an arrow into the air along a flight path, the flight path being parabolic and having an apex, the arrow having:

a shaft having a shaft first end and a shaft second end;

a plurality of vanes attached to the shaft at the shaft second end; and an arrow end connected to the shaft first end, the arrow end including:

a main body having a first end and a second end, wherein the main body defines a longitudinal axis;

a tip positioned at the first end of the main body, the tip having a blunt end;

an arrow shaft connector positioned at the second end of the main body, the arrow shaft connector being connected to the shaft first end of the arrow shaft; and flexible wings extending laterally from the main body in a direction at least partially toward the second end of the main body, each wing having a free end configured to move toward and away from the longitudinal axis;

deflecting the flexible wings away from the longitudinal axis of the main body of the arrow end after the arrow reaches the apex of its flight path; and reducing a fall velocity of the arrow by deflecting air across the flexible wings.

21. The method of claim 20, further comprising signaling via an auxiliary instrument attached to the main body of the arrow end.

22. The method of claim 21, wherein the auxiliary instrument includes at least one of a camera, a communications beacon, a communications antenna, a LED, or a whistle.

* * * * *